US010648289B2

(12) United States Patent
Leiper et al.

(10) Patent No.: US 10,648,289 B2
(45) Date of Patent: May 12, 2020

(54) DOWNHOLE MILLING TOOL

(71) Applicant: Odfjell Partners Invest Ltd, Tananger (NO)

(72) Inventors: Simon Leiper, Aberdeen (GB); Raymond Cain, Cheltenham (GB)

( * ) Notice: Subject to any disclaimer, the term of this patent is extended or adjusted under 35 U.S.C. 154(b) by 129 days.

(21) Appl. No.: 15/160,864

(22) Filed: May 20, 2016

(65) Prior Publication Data

US 2016/0348473 A1 Dec. 1, 2016

(30) Foreign Application Priority Data

May 27, 2015 (GB) ..... 1509015.2

(51) Int. Cl.
*E21B 37/02* (2006.01)

(52) U.S. Cl.
CPC ..... *E21B 37/02* (2013.01)

(58) Field of Classification Search
CPC ..... E21B 37/02; E21B 10/26
See application file for complete search history.

(56) References Cited

U.S. PATENT DOCUMENTS 2,811,210 A * 10/1957 Guillot ..... E21B 37/02 166/173
4,421,182 A 12/1983 Moody et al.
(Continued)

FOREIGN PATENT DOCUMENTS

CN 2521386 Y 11/2002
GB 2336612 A 10/1999
(Continued)

OTHER PUBLICATIONS

European Search Report for GB 1509015.2, Intellectual Property Office (dated Sep. 8, 2015).
(Continued)

*Primary Examiner* — Robert E Fuller
*Assistant Examiner* — Lamia Quaim

(57) ABSTRACT

A downhole milling tool (100) operable to remove unwanted debris from an interior wall of a pipeline, well casing or other tubular in which the tool (100) is deployable. The tool (100) comprises a hollow tool body (1, 11) mountable on a drill string and an annular element (8) mountable about an outside surface of the tool body (1). The annular element (8) houses at least one elongate milling blade (12). The at least one milling blade (12) is configured such that it always projects from an outside surface of the annular element (8) and includes an elongate cutting face (36). The annular element (8) is configured to be rotatably coupled to the tool body (1) in an active state and rotatably decoupled from the tool body (1) in an inactive state such that the annular element (8) and the tool body (1) are rotationally dependent when coupled and rotationally independent when decoupled. The cutting faces (36) are each configured to be operable to remove unwanted debris only when the annular element (8) and the tool body (1) are rotationally dependent, such that, in use, rotation of the tool body (1) effects operation of the milling blades (12) to remove unwanted debris and to be inoperable to remove unwanted debris when the annular element (8) and the tool body (1) are rotationally independent.

23 Claims, 2 Drawing Sheets

(56) References Cited

U.S. PATENT DOCUMENTS

| | | | | |
|---|---|---|---|---|
| 4,452,307 | A * | 6/1984 | Horton | E21B 4/006 166/174 |
| 5,819,353 | A | 10/1998 | Armell et al. | |
| 6,152,221 | A | 11/2000 | Carmichael et al. | |
| 6,401,813 | B1 * | 6/2002 | Carmichael | E21B 34/02 166/173 |
| 2001/0022223 | A1 | 9/2001 | Howlett | |
| 2002/0104649 | A1 | 8/2002 | Allen | |
| 2005/0056429 | A1 | 3/2005 | Du et al. | |
| 2007/0095573 | A1 * | 5/2007 | Telfer | E21B 21/10 175/57 |
| 2009/0169319 | A1 | 7/2009 | Hart | |
| 2010/0243257 | A1 | 9/2010 | Krieg et al. | |
| 2011/0214873 | A1 * | 9/2011 | Krieg | E21B 37/00 166/311 |
| 2011/0284233 | A1 * | 11/2011 | Wu | E21B 10/32 166/321 |
| 2013/0192818 | A1 | 8/2013 | Winn et al. | |
| 2013/0248249 | A1 | 9/2013 | Xu | |
| 2014/0116712 | A1 * | 5/2014 | Bansal | E21B 37/00 166/311 |
| 2015/0027713 | A1 | 1/2015 | Pennison | |
| 2015/0027780 | A1 * | 1/2015 | Hern | E21B 37/02 175/57 |
| 2015/0114665 | A1 | 4/2015 | Hora et al. | |

FOREIGN PATENT DOCUMENTS

| | | | |
|---|---|---|---|
| GB | 2411919 | A | 9/2005 |
| GB | 2411920 | A | 9/2005 |
| WO | 9954590 | A1 | 10/1999 |
| WO | 0107752 | A1 | 2/2001 |
| WO | 0235055 | A1 | 5/2002 |
| WO | 03087526 | A1 | 10/2003 |
| WO | 2004022907 | A1 | 3/2004 |
| WO | 2004067908 | A1 | 8/2004 |
| WO | 2004088091 | A1 | 10/2004 |
| WO | 2006016102 | A1 | 2/2006 |
| WO | 2007003894 | A2 | 1/2007 |
| WO | 2010015861 | A2 | 2/2010 |
| WO | 2010048167 | A2 | 4/2010 |

OTHER PUBLICATIONS

International Search Report, PCT/EP2015/056540, EPO (dated Mar. 3, 2016).

Patents Act 1977: Search Report Under Section 17(5), GB1405967.9, IPO (dated Sep. 23, 2014).

* cited by examiner

DOWNHOLE MILLING TOOL

FIELD OF THE INVENTION

The present invention relates to a selectively activated downhole milling tool operable to remove unwanted debris from an interior wall of a pipeline, well casing or other tubular, wherein the tool is effective in removing material only upon rotation of the tool.

INCORPORATION BY REFERENCE

This patent application incorporates by reference in its entirety patent application GB 1509015.2 filed May 27, 2015, entitled "Downhole Milling Tool".

BACKGROUND TO THE INVENTION

When an oil or gas well is drilled, it is common to run and cement a casing across the hydrocarbon bearing formations to form a pressure tight and safe method of controlling the formation pressures. During the subsequent completion phase of the well the casing is perforated to allow oil to flow. Typically, the casing is perforated using shaped charges to create a controlled explosion which blast multiple small holes through the casing called perforations. Burrs are generally created as a result of creating such perforations through the casing wall. A burr is a raised edge or comprises small pieces of material that remain attached to the edge of the perforation after the process of creating perforations is complete; burrs are generally sharp and they protrude into the wellbore. As such, if burrs remain they can cause damage to subsequent insertions to the casing, for example production screens or packers.

Following the perforation process the next stage of the completion phase is often to run packer assemblies into the casing. Packers are located in the casing in a position that straddles the perforated areas and provide means to control the flow of hydrocarbons into the wellbore.

A packer is designed to grip and seal against the inside diameter of the pipeline or well casing in which the tool is deployed. A sealing function is provided by sealing elements, which are generally composed of flexible elastomeric material, for example rubber. It will be appreciated that the elastomeric material may be vulnerable to damage or tearing if burrs remain in the casing. If torn or damaged by the burrs the ability to seal may be diminished and leakage is likely to occur. This may result in costly remedial operations.

To prevent such damage it is common to run a string mill assembly or a scraper into the casing to dress the casing or remove any perforation burrs.

Tools have been designed which incorporate the aggressiveness of a mill with the flexibility of the scraper such that the scraper blocks include milling media to remove the perforation burrs. Unfortunately, in such tools the blades can be too aggressive, where dressing the perforations may be performed as a first stage operation, but continued movement of the tool after milling is complete often causes unwanted damage to the casing.

U.S. Pat. No. 7,191,835 describes a milling tool which can be disengaged from the casing wall. The tool incorporates a series of milling blades which are supported on springs and where the milling blades are biased into contact with the casing wall such that movement of the tool removes burrs. The blades are retractable, where the blades are moved inside the tool body by the action of dropping a ball onto a ball seat and increasing fluid pressure behind the ball until a shear pin shears to allow downward movement of a supporting sleeve and therefore re-positioning of the springs such that the blades are no longer supported in an extended position. From this position the blades are retractable and no longer in contact with the casing wall.

U.S. Pat. No. 8,141,627 also describes an example of a tool that includes retractable milling blades operable to clean inside a casing when the mill blades are extended and to prevent any cutting action when the blades are retracted.

Both examples described briefly above may be effective as deburring tools. However, the retractable nature of each tool means there is typically a space between the blades and the operating sleeve. It will be appreciated that this space is susceptible to filling with debris, which can prevent the blades from retracting. Neither system provides any feedback to an operator. Therefore, as a result an operator may continue with operations unaware that the tool is still extended, or at least is not fully retracted. Continued operation of the tool may result in damage to the casing. Such damage may be as detrimental as the burrs to subsequently deployed components.

It is desired to provide an improved deburring tool.

SUMMARY OF THE INVENTION

In a first aspect, a downhole milling tool can be operable to remove unwanted debris from an interior wall of a pipeline, well casing or other tubular in which the tool is deployable. The tool can comprise a tool body mountable on a drill string and can have an annular element mountable about an outside surface of the tool body, wherein the annular element houses at least one milling blade, and wherein the at least one milling blade is configured such that it always projects from an outside surface of the annular element. Each milling blade includes an elongate cutting face. The annular element can be configured to be rotatably coupled to the tool body in the active state and rotatably decoupled from the tool body in an inactive state. The annular element and the tool body are rotationally dependent when coupled and rotationally independent when decoupled. The cutting faces are each configured to remove unwanted debris only when the annular element and the tool body are rotationally dependent, such that, in use, rotation of the tool body effects operation of the milling blades to remove unwanted debris, and the cutting faces are inoperable to remove unwanted debris when the annular element and the tool body are rotationally independent.

Selective rotation of the annular element relative to the tool body means that the ability to remove burrs etc from an internal surface of a pipeline or casing wall is controlled.

Each milling blade extends longitudinally and substantially parallel with the rotational axis of the tool body and the annular element and the cutting face may be substantially parallel with the rotational axis of the tool body and the annular element and wherein each cutting face is substantially parallel with the rotational axis of the tool body and the annular element.

Alternatively, the at least one milling blade may form at least part of a helix such that upon rotation the cutting face defines a helix relative to the rotational axis of the tool body and the annular element The annular element may include at least one opening through which the at least one milling blade projects. The at least one milling blade may be radially biased such that the at least one blade always project from the opening through the annular element. The at least one milling blade may be spring loaded. Compression springs housed in recesses to a rear surface of the at least one milling blade may provide the bias to push the blades to project outwards. The downhole tool may comprise a plurality of milling blades. The downhole tool may comprise a three or more milling blades.

Advantageously, a spring loaded milling blade is aggressive enough, and therefore effective, to fully remove steel burrs, which often remain when perforations are created through a steel casing. In addition, circumferentially spaced spring loaded blades compensate for ovality and manufacturing tolerances within the pipeline or casing in which the tool is deployed. As such a substantially smooth milled surface is more likely than the milled surface produced by the operation of a string mill system.

The blade or blades are operable to remove unwanted debris upon rotation only.

A cutting surface may be provided on one face of the blade such that cutting is enabled in one rotational direction only. A cutting surface may be provided on a plurality of faces such that cutting is enabled in both clockwise and counterclockwise directions. The cutting surface may be provided by coating at least part of the blade surface. The coating may be tungsten carbide. Alternatively, the coating may be polycrystalline diamond, ceramic or hardened alloy steel.

The downhole tool may further comprise an inner tubular member, a drive system and one or more sacrificial elements, wherein in an active state the annular element and the tool body are coupled via interaction of the drive system, the inner tubular member and one or more sacrificial elements.

The drive system comprises a drive member extending radially from the inner tubular member, wherein the drive member engages the annular element and the tool body in the active configuration and disengages the annular element from the tool body in the inactive configuration.

The sacrificial elements may be arranged to break when at least a first predetermined fluid pressure is applied to the tool body, wherein upon reaching the first predetermined pressure the inner tubular member is configured to displace axially thereby displacing the drive member relative to the tool body and the annular element.

A stop may be provided against which the inner tubular member comes to rest when the annular element disengages from the tool body.

The tool body may further comprise a deactivation ball and ball seat within an axial bore of the tool body, wherein the deactivation ball can be released upon completion of the milling operations in relation to the ball seat, wherein the ball comes to rest on the ball seat to allow fluid pressure to increase within the system to the at least first predetermined level.

The downhole tool may further comprise a secondary sacrificial system and a normally closed fluid bypass path located between the tool body and the inner tubular member, wherein, in use, increasing fluid pressure in the system breaks the secondary sacrificial system thereby releasing the ball seat and axially displacing the ball seat to open the fluid bypass path, wherein fluid flow via the fluid bypass path is indicative of the successful decoupling of the annular member from the tool body. Fluid flow via the fluid bypass is indicative that the inner tubular member has been completely stroked and is at rest and is detectable by an operator as confirmation that the cutting action of the milling blades has been deactivated and that further downhole operations can continue without damage to the pipeline or casing in which the tool is deployed.

The sacrificial elements may be one or more shear pins. Primary shear pins that are configured to shear at a first predetermined pressure facilitate decoupling of the annular member from the tool body in a first instance and secondary shear pins that are configured to shear at a second predetermined pressure facilitate release of the ball seat to allow fluid to flow through the fluid bypass path.

The annular element may further comprise flow bypass areas between the milling blades, wherein the bypass areas are operable to allow substantially unhindered passage of fluids through the bypass areas to facilitate removal of milling debris. The flow bypass areas may be rebated areas on the outer wall of the annular member. It will be appreciated that unhindered passage of fluids along the bypass areas avoids unnecessary build up of debris within the system, which in prior art systems led to jamming of retractable blades in an extended state or a partially retracted state, which typically resulted in damage to the casing wall.

The annular element and the tool body are arranged to be selectively coupled and uncoupled such that when the tool is lowered into the wellbore the annular element and tool body are uncoupled and therefore are rotationally independent and the blades do not cut. When the tool has reached the required depth the annular element and the tool body are coupled such that they are rotationally dependent, wherein upon rotation the blades actively remove material from the casing wall. The tool may be reamed across a required depth to remove material over a desired length of the casing.

Uncoupling of the annular element and the tool body prevents rotation of the cutting tool and therefore deems it ineffective in removing material from the casing wall.

When the milling process is complete the tool can be deactivated by uncoupling the annular element and the tool body to allow, for example, subsequent wellbore cleaning operations which require rotation of the drill string.

Accidental damage or wear of the casing is also minimised by uncoupling the annular element and the tool body.

BRIEF DESCRIPTION OF THE DRAWINGS

Embodiments of the invention are further described hereinafter with reference to the accompanying drawings, in which.

DESCRIPTION

Figure 1:
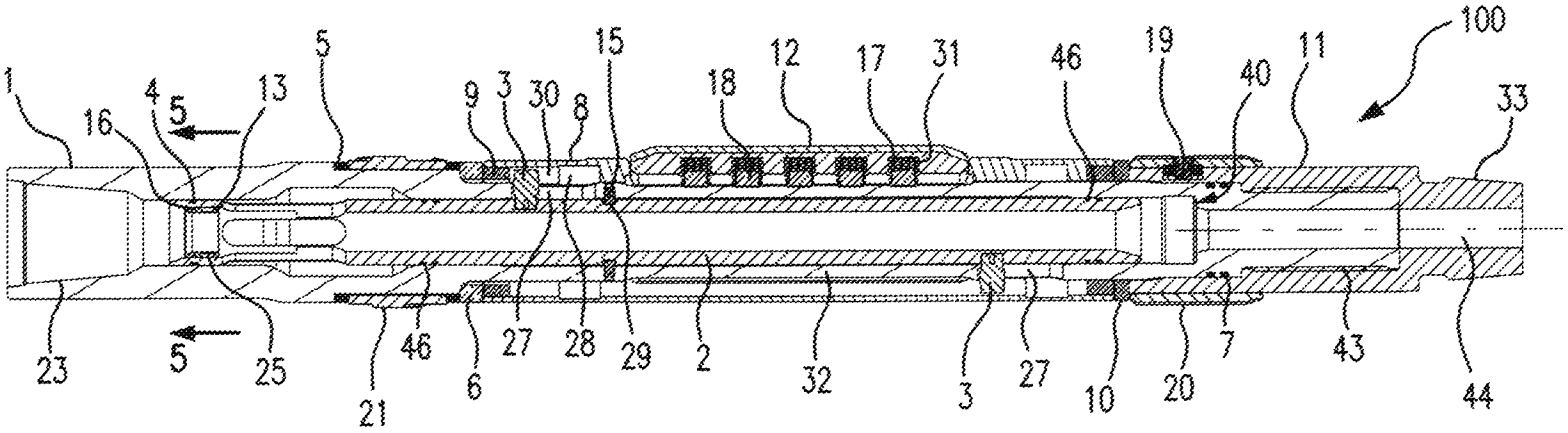
FIG. 1 is a schematic illustration of a downhole tool in an active state according to an embodiment of the present invention.
Figure 5:
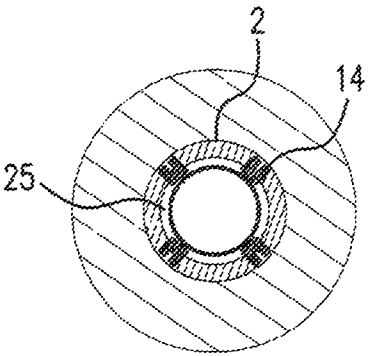
FIG. 5 is a schematic illustration of a sectional view of FIG. 1 to illustrate a shear pin feature associated with the tool being in the feedback state of FIG. 4.
Figure 2:
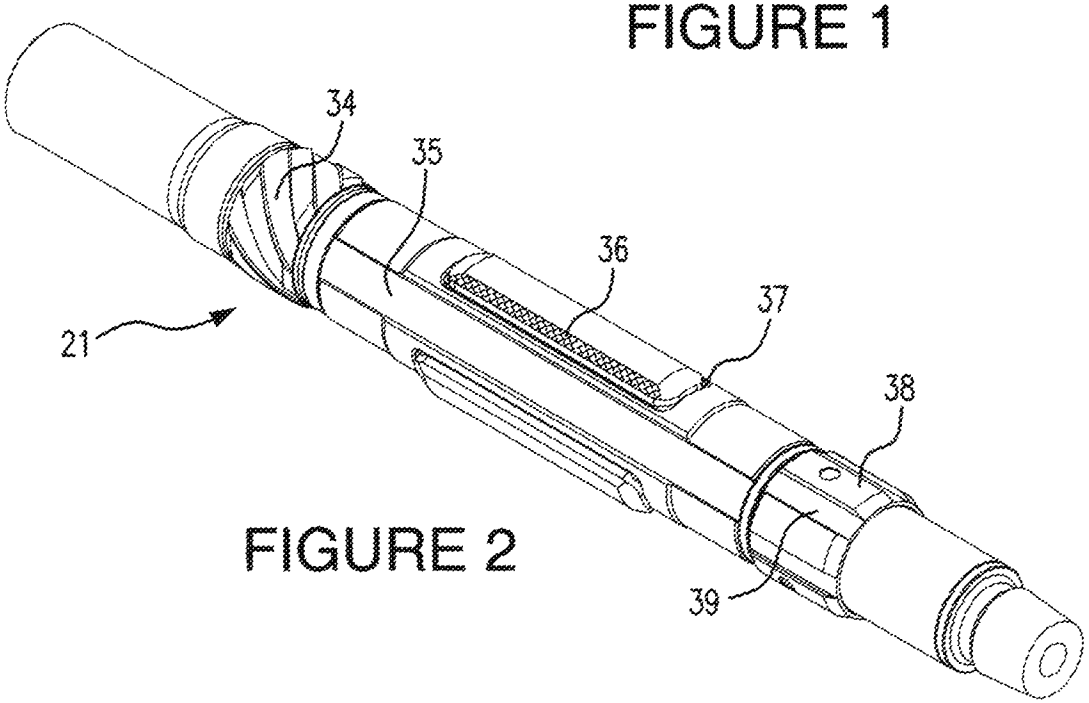
FIG. 2 is a schematic illustration of a perspective view of the downhole tool as illustrated in FIG. 1.

Referring to FIGS. 1 to 5 a downhole tool 100 is illustrated. The downhole tool 100 is a downhole milling tool operable to remove unwanted debris from an interior wall of a pipeline or well casing in which the tool is deployed. The downhole tool 100 includes an upper mandrel 1 and a lower mandrel 11 for connecting the tool 100 to a drill string (not illustrated). The upper mandrel 1 provides the tool body about which, within which and to which other elements of the downhole tool are connected.

The upper mandrel 1 includes an axial bore 44 which facilitates pumping/transport of fluids downhole. A series of slots 27 are provided through the upper mandrel 1 to accommodate drive pins 3, which actively engage a cage 8 (described further below) to the upper mandrel 1.

The upper mandrel 1 also includes, in the illustrated example, an internal threaded connection 23 at its upper end and an external threaded connection 43 at its lower end. The upper internal threaded connection 23 facilitates connection of the downhole tool 100 to a drill string (not illustrated). The lower external threaded connection 43 facilitates connection of the upper mandrel 1 to the lower mandrel 11.

Components of the downhole tool are assembled via the axial bore 44 and the body of the upper mandrel 1. Therefore, connection of the lower mandrel 11 to the upper mandrel 1 completes the assembly of the downhole tool 100 and acts to retain all internal components within the axial bore 44 whilst also providing a rigid and secure attachment to the upper mandrel 1. The lower mandrel 11 facilitates connection of the downhole tool 100 to a drill string via an external threaded connection 33 at its lower end. The lower mandrel 11 also secures the cage 8 and its related components in place.

The lower mandrel 11 is hydraulically sealed relative to the upper mandrel by O-ring seals 7.

A milling sleeve 20 is attached to the lower mandrel 11. The milling sleeve 20 provides a fixed mill element to the tool and performs some deburring when in use. The milling sleeve 20 includes a raised milling face 38 and rebated flow bypass channels 39 (see FIG. 2). In the illustrated example (see FIG. 1) a lock plate and screw 19 attaches the milling sleeve 20 to the lower mandrel 11. However, it will be appreciated that other fastening methods/components could be used, for example a threaded connection, bolts, lock-wire, tongue and groove, welded or other attachment methods. Furthermore the milling sleeve 20 may be an integral part of the lower mandrel 11.

The cage 8 is in the form of an annular element, which is mounted about an outside surface of the upper mandrel 1. The cage 8 is mounted to a shaft portion 32 of the upper mandrel 1 and is configured to rotate relative to the shaft 32 with the provision of radial bearings 9 and axial bearings 6, 10.

The cage 8 includes longitudinal slots/windows 37 through the cage wall. In the illustrated example three slots 37 are provided and a mill blade 12 extends through each slot 37. Each mill blade 12 is biased radially away from the central axis of the mandrel 1 by a spring force that pushes the blades 12 towards the outside of the downhole tool assembly 100 such that the cutting surfaces of the blades 12 form the largest circumference of the assembly 100.

In the illustrated example, a series of springs 17 is engaged with each mill blade 12. In the illustrated example, each mill blade 12 includes a series of spring housing bores 31 into which a spring 17 is located, for example a coil compression spring 17. The bore wall 31 facilitates alignment of the spring 17 to maintain uniform pressure on the interior of the mill blade 12 such that each blade 12 always actively extends from its slot 37. Each spring 17 is compressed within the bore wall 31 such that the resulting spring force actively pushes the blades 12 radially outwardly.

The cage 8 is arranged to rotate dependently or independently relative to the upper mandrel 1. As such a bearing 18 is provided within each bore 31 such that the cage 8 is allowed to rotate independently of the upper mandrel 1 when in the deactivated state. The provision of the bearing 18 between the spring 17 and the shaft 32 reduces possible damage to the shaft 32 or spring 17 when the cage 8 and upper mandrel independently rotate (as discussed further below).

Rotation of the cage 8 relative to the mandrel 1 is controlled primarily by the engagement and disengagement of a drive system comprising the drive pin 3 which is arranged to engage in a drive slot 30 when the tool 100 rotates.

In the illustrated example, the cage 8 also includes a series of flow bypass channels 35 between the slots 37. The flow bypass channels 35 allow unhindered passage of fluids, which will facilitate removal of any milling debris which is created when the tool 100 is used.

In the illustrated example, the mill blades 12 each include a tungsten carbide coating 36 suitable to enhance the cutting action of the blades 12 when used. The coating 36 is arranged on one side of each blade 12 such that upon rotation of the tool in a one direction, for example clockwise, the coating 36 forms a cutting surface to remove debris from the interior of the pipeline or well casing. It will be appreciated that tungsten carbide is described as an example of a suitable material to enhance the cutting performance of each mill blade 12. The mill blades 12 may include alternative suitable materials as coating or inserts to perform the cutting action.

The upper mandrel 1 houses an inner sleeve 2 inside the axial bore 44. The inner sleeve 2 is configured to move axially within the axial bore 44 to control relative rotation of the upper mandrel 1 and the cage 8 as discussed further below with reference to FIGS. 3, 4 and 5.

The inner sleeve 2 is sealingly engaged inside the axial bore 44 of the upper mandrel 1 via a series of O-rings 46 provided near the ends of the inner sleeve 2 such that a hydraulic seal is provided between the upper mandrel 1 and the sleeve 2 to restrict fluid flow to downwards through the axial bore 44.

The inner sleeve 2 is locked in the position illustrated in FIG. 1 by a shear pin 15 which protrudes through the upper mandrel 1 into a shear pin groove 29. The shear pin 15 is designed such that it shall shear at a predetermined pressure thereby releasing the inner sleeve 2 to allow axial movement downwards towards the lower mandrel 11.

The drive pin 3 is connected to the inner sleeve 2 and passes through an opening provided in the upper mandrel 1 to be received in the longitudinal slot 30 provided on an inside surface of the cage 8. When the drive pin 3 is located in the slot 30 the cage 8 and the upper mandrel 1 are rotationally dependent such that the tool 100 is in an active state i.e. when upon rotation of the tool 100 the milling blades 12 remove debris from the interior wall of the pipeline or well casing in which the tool is deployed.

To render the system inactive, i.e. when upon rotation of the tool 100, the mill blades do not remove debris from the interior wall of the pipeline or well casing in which the tool is deployed, the drive pin 3 is physically displaced along the slot 30 and is received in a groove 28 which, in a rotational sense, disconnects the cage 8 from the upper mandrel 1. Displacement of the drive pin 3 is controlled by axial movement of the sleeve 2 along the axial bore 44.

Figure 3:
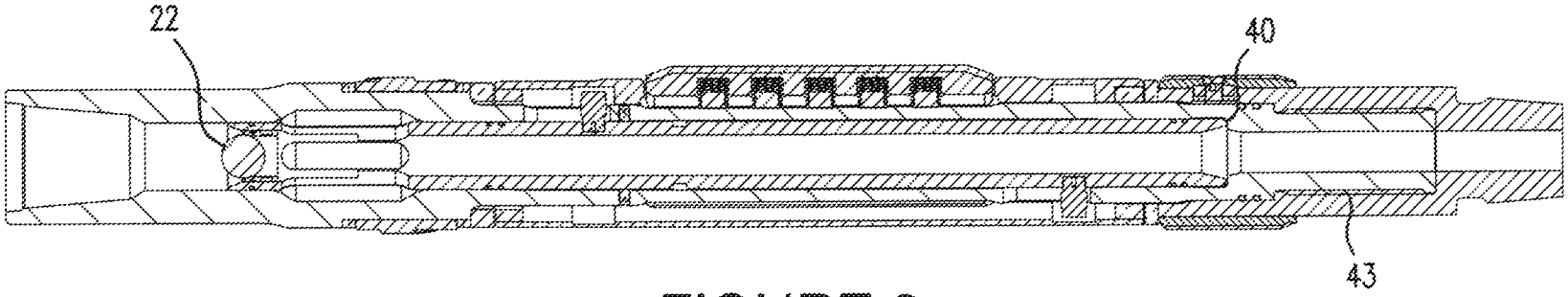
FIG. 3 is a schematic illustration of the downhole tool of FIGS. 1 and 2 in a deactivate state.
Figure 4:
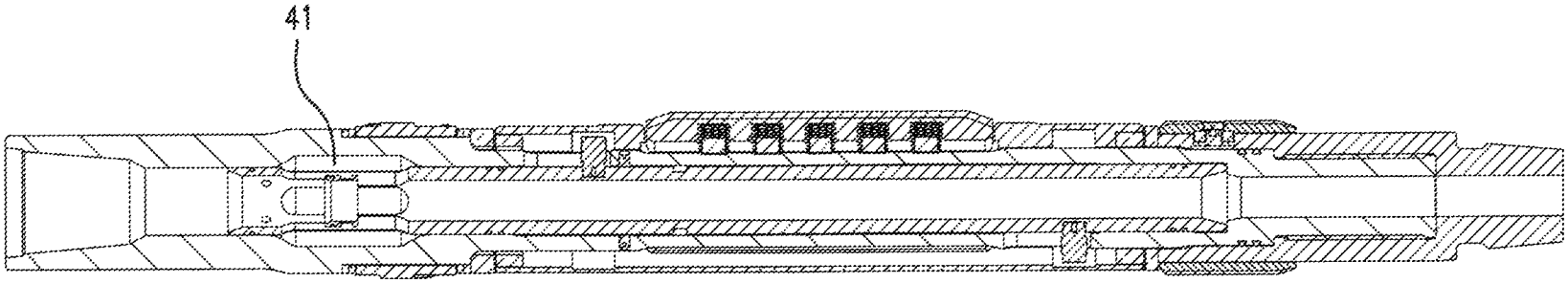
FIG. 4 is a schematic illustration of the downhole tool of FIGS. 1 and 2 in a feedback capable state.

FIGS. 3 and 4 illustrate the downhole tool 100 in a configuration where the system is inactive as described above i.e. where the drive pin 3 is located in the groove 28 (see FIGS. 3 and 4). FIG. 4 illustrates a configuration where pressure feedback is enabled such that an operator is informed that the upper mandrel 1 and the cage 8 are rotatably independent before beginning subsequent downhole operations.

Deactivation of the milling process is controlled by pressurization of the system.

Referring to FIGS. 1, 3 and 4, the tool 100 includes a ball seat 13 and a deactivation ball 22 at the upper end of the sleeve 2 and located inside the bore 44 of the upper mandrel 1. A series of O-rings 4, 16 are provided such that the seat 13 and a carrier are hydraulically sealed relative to the inner wall of the upper mandrel 1.

The seat 13 is configured such that upon completion of the deburring/milling process the ball 22 is released and lands on the ball seat 13 to allow pressure build up within the system. When a first predetermined pressure is reached shear pins 15 are sheared such that the continued fluid pressure acts on the inner sleeve 2 to displace the sleeve 2 axially relative to the axial bore 44. The inner sleeve 2 is displaced downward (towards the lower mandrel 11) from the active position as illustrated in FIG. 1 to the inactive position as illustrated in FIG. 3. Simultaneously, the drive pins 3 are displaced along the drive slot 30 and are received in the groove 28 when the inner sleeve 2 has completed a full stroke. In this configuration the upper mandrel 1 and the cage 8 rotate independently. Therefore, when the upper mandrel 1 is rotated, the cage 8 and mill blades 12 no longer rotate. As such the tool assembly 100 can be rotated during subsequent operations without risk of damage to the interior wall of the pipeline or well casing in which the tool is deployed.

In the configuration illustrated in FIG. 3 the inner sleeve 2 rests against an abutment 40.

Whilst in the configuration represented by FIG. 3 the milling blades 12 are inactive it will be appreciated that if the inner sleeve 2 does not complete the axial displacement from the active configuration as illustrated in FIG. 1 to the inactive/deactivated configuration of FIG. 3 the drive pin 3 may remain engaged with the slot 30 and the cage 8 and upper mandrel 1 will remain rotatably dependent and damage to the interior wall of the pipeline or well casing in which the tool is deployed may occur if subsequent operations are conducted. The system therefore includes a further step to enable feedback to an operator that indicates that the inner sleeve 2 has fully stroked, which confirms that the drive pin 3 is disconnected from the slot 30. The further step includes increasing the fluid pressure such that higher rated secondary shear pins 14 are sheared (see FIG. 5). The secondary shear pins are held in grooves 25 until the higher rated pressure is reached. By shearing the secondary shear pins 14 the ball seat 13 is released and moves axially downwards and comes to rest adjacent an internal bypass 41 (see FIG. 4) provided between the outside surface of the inner sleeve 2 and the inner surface of the upper mandrel 1. The internal bypass 41 allows fluid to be pumped through and provides feedback that can be detected at surface by an operator. This confirms that the inner sleeve is fully stroked and that it is safe to proceed with further downhole operations without risk of damage to the casing by the mill blades 12.

A centralizer 21 is fitted to the upper end of the upper mandrel 1 and includes a plurality of flow bypass channels 34. The centralizer 21 is fitted with bearings 5 which allow the centralizer to rotate about the upper mandrel 1. The centralizer 21 acts to centre the downhole tool assembly 100 relative to the interior wall of the pipeline or well casing in which the tool 100 is deployed. In the illustrated example, the centralizer 21 is not rotationally fixed and therefore assists in easy rotation of the tool 100.

When the tool 100 is run into the wellbore the inner sleeve 2 is in the upper position with the cage 8 is locked rotationally to the tool 100 as shown in FIG. 1.

When the tool 100 reaches the desired depth it can be rotated to allow the mill blades 12 to remove the perforation burrs or other such debris from the interior wall of the pipeline or well casing in which the tool 100 is deployed. Any debris generated by the milling process can be circulated through the various bypass channels 35, 39 described above.

When inserting the tool the centralizer 21 provides centralization to assist in the easy rotation of the tool and the action of the springs 17 ensure that the mill blades 12 fully contact the internal circumference of the pipeline or casing being milled and allows for ovality in the internal surface of the pipeline or casing.

In this stage of the deburring/cleaning process the cage 8 and the upper mandrel 1 are engaged and rotationally dependent.

When the deburring/cleaning process is complete the cage 8 and the upper mandrel 1 need to be disengaged such that they are rotationally independent. When the cage 8 and the upper mandrel 1 are rotationally independent the mill blades 12 no longer cut the surface of the interior wall of the pipeline or well casing in which the tool is deployed. As such further downhole operations can be commenced without physically removing the downhole tool 100 described herein and without risk of further damage to the interior wall of the pipeline or well casing in which the tool is deployed.

It will be appreciated that the above description relates to an exemplary embodiment. It should further be appreciated that the shape and form of the slots/windows 37 through the cage wall 8 may be elongate to accommodate elongate milling blades or a plurality of milling blades protruding through each slot/window 37. However, the elongate form of the slot/window 37 may define at least part of a helix such that, in use, the milling blades 12 trace a helical path as the tool 100 rotates and reams within the pipeline or well casing in which the tool 100 is deployed.

Although a variety of embodiments have been described herein, these are provided by way of example only, and many variations and modifications on such embodiments will be apparent to the skilled person and fall within the scope of the present invention, which is defined by the appended claims and their equivalents.

The invention claimed is:

1. A downhole milling tool, comprising:

a hollow tool body mountable on a drill string;

an annular element mountable about an outside surface of the tool body, wherein the annular element houses a portion of at least one elongate milling blade, the annular element including at least one opening through which the at least one milling blade projects; wherein the at least one milling blade is radially biased to project outwards and projects outwardly beyond an outside surface of the annular element;

each milling blade includes an elongate cutting face;

wherein the annular element is configured to be rotatably coupled to and rotationally dependent on the tool body in an active configuration and rotatably decoupled and rotationally independent from the tool body in an inactive configuration;

wherein the tool body comprises an inner tubular member and a drive system, wherein the drive system comprises a drive member extending radially from the inner tubular member, wherein the drive member rotationally engages the annular element and rotatably couples the annular element to the tool body when in the active configuration and disengages from the annular element in the inactive configuration;

wherein the cutting faces are each configured to remove unwanted debris only when the annular element and the tool body are rotationally dependent, such that, in use, rotation of the tool body effects operation of the milling blades to remove unwanted debris; and wherein the cutting faces are inoperable to remove unwanted debris when the annular element and the tool body are rotationally independent.

2. A downhole tool as claimed in claim 1, wherein the at least one milling blade extends longitudinally and substantially parallel with the rotational axis of the tool body and the annular element and wherein each cutting face is substantially parallel with the rotational axis of the tool body and the annular element.

3. A downhole tool as claimed in claim 1, wherein the at least one milling blade forms at least part of a helix such that upon rotation the cutting face defines a helix relative to the rotational axis of the tool body and the annular element.

4. A downhole tool as claimed in claim 1, wherein the annular element has at least one opening through which the at least one milling blade projects.

5. A downhole tool as claimed in claim 4, wherein the at least one milling blade is radially biased such that the at least one blade always projects from the opening through the annular element.

6. A downhole tool as claimed in claim 4, wherein the at least one milling blade is spring loaded.

7. A downhole tool as claimed in claim 6, wherein the bias to push the at least one blade to project outwards is provided by compression springs housed in recesses in a rear surface of the at least one milling blade.

8. A downhole tool as claimed in claim 1, further comprising a plurality of milling blades.

9. A downhole tool as claimed in claim 1, further comprising three or more milling blades.

10. A downhole tool as claimed in claim 1, wherein each milling blade comprises a cutting surface on one face of the blade such that cutting is enabled in one rotational direction only.

11. A downhole tool as claimed in claim 1, wherein each milling blade comprises a cutting surface on a plurality of faces such that cutting is enabled in both clockwise and counterclockwise directions.

12. A downhole tool as claimed in claim 1, wherein the cutting surface is provided by coating at least part of the blade surface.

13. A downhole tool as claimed in claim 12, wherein the coating is tungsten carbide.

14. A downhole tool as claimed in claim 1, wherein a plurality of sacrificial elements which in the active configuration couple the inner tubular member and the tool body, said plurality of sacrificial elements are configured to break when at least a first predetermined fluid pressure is applied to the tool body, wherein upon reaching the first predetermined pressure the inner tubular member is configured to displace axially thereby displacing the drive member relative to the tool body and the annular element.

15. A downhole tool as claimed in claim 14, further comprising a stop member against which the inner tubular member comes to rest when the annular element disengages from the tool body.

16. A downhole tool as claimed in claim 14, further comprising a deactivation ball and a ball seat within an axial bore of the tool body, wherein the deactivation ball is released into the axial bore of the tool body upon completion of a milling operation to travel to the to the ball seat; and wherein after the deactivation ball travels to the ball seat, the deactivation ball rests on the ball seat thereby allowing fluid pressure within the bore to increase to the at least first predetermined level.

17. A downhole tool as claimed in claim 16, further comprising a secondary sacrificial system and a normally closed fluid bypass path located between the tool body and the inner tubular member, wherein, in use, increasing fluid pressure in the system can break the secondary sacrificial system thereby releasing the ball seat and axially displacing the ball seat to open the normally closed fluid bypass path, wherein fluid flow via the open normally closed fluid bypass path is indicative of the successful decoupling of the annular member from the tool body.

18. A downhole tool as claimed in claim 14, wherein the plurality of sacrificial elements comprise one or more shear pins.

19. A downhole tool, as claimed in claim 16, further comprising:

primary shear pins, which are configured to shear at a first predetermined pressure to facilitate decoupling of the annular member from the tool body in a first instance, and secondary shear pins that are configured to shear at a second predetermined pressure to facilitate release of the ball seat to allow fluid to flow through the fluid bypass path.

20. A downhole tool, as claimed in claim 1, wherein the annular element further comprises flow bypass areas between the milling blades, wherein the bypass areas are operable to allow substantially unhindered passage of fluids through the bypass areas to facilitate removal of milling debris.

21. A downhole tool as claimed in claim 20, wherein the flow bypass areas comprise rebated areas on the outer wall of the annular member.

22. A downhole tool as claimed in claim 1, wherein the annular element and the tool body are arranged to be selectively coupled and uncoupled such that when in use when the tool is lowered into a pipeline, casing or tubular the annular element and tool body are uncoupled and are rotationally independent, wherein the blades do not cut until the tool has reached a required depth at which point the annular element and the tool body are coupled such that they are rotationally dependent, and wherein upon rotation the blades are engaged and operable to actively remove material from an inside wall of a pipeline, casing or tubular in which the tool is deployed.

23. A method of removing burrs or debris from an internal surface of a pipeline, casing or tubular, comprising the steps of:

providing a downhole milling tool, comprising:

a hollow tool body mountable on a drill string;

an annular element mountable about an outside surface of the tool body, wherein the annular element houses a portion of at least one elongate milling blade, the annular element including at least one opening through which the at least one milling blade projects; wherein the at least one milling blade is radially biased to project outwards and projects outwardly beyond an outside surface of the annular element;

each milling blade includes an elongate cutting face;

wherein the annular element is configured to be rotatably coupled to and rotationally dependent on the tool body in an active configuration and rotatably decoupled and rotationally independent from the tool body in an inactive configuration;

wherein the tool body comprises an inner tubular member and a drive system, wherein the drive system comprises a drive member extending radially from the inner tubular member, wherein the drive member rotationally engages the annular element and rotatably couples the annular element to the tool body when in the active configuration and wherein the drive member rotationally disengages from the annular element in the inactive configuration;

wherein the cutting faces are each configured to remove unwanted debris only when the annular element and the tool body are rotationally dependent, such that, in use, rotation of the tool body effects operation of the milling blades to remove unwanted debris; and wherein the cutting faces are inoperable to remove unwanted debris when the annular element and the tool body are rotationally independent;

lowering the downhole milling tool without rotation into a pipeline, casing or tubular to a desired depth;

rotating and reciprocating the tool across a required depth such that the cutting faces are operable to remove unwanted debris from the internal surface of the pipeline, casing or tubular in which the tool is deployed;

decoupling the annular member and the tool body such that the annular element and the tool body are rotationally independent and the cutting faces are inoperable to remove unwanted debris.

* * * * *